US011131330B1

(12) United States Patent
Davis et al.

(10) Patent No.: US 11,131,330 B1
(45) Date of Patent: Sep. 28, 2021

(54) CRIMP RETAINED HYDRAULIC CYLINDER HEAD AND CAP

(71) Applicant: Caterpillar Inc., Peoria, IL (US)

(72) Inventors: Tony Barton Davis, Sumter, SC (US); Thomas Kwok Fai Yeung, Bolingbrook, IL (US); Richard Griffith Marsh, Lugoff, SC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/834,426

(22) Filed: Mar. 30, 2020

(51) Int. Cl.
*F15B 15/14* (2006.01)

(52) U.S. Cl.
CPC ..... *F15B 15/1442* (2013.01)

(58) Field of Classification Search
CPC ..... F15B 15/1442; F15B 15/1438
See application file for complete search history.

(56) References Cited

U.S. PATENT DOCUMENTS 2,403,020 A * 7/1946 Parsons ..... B60J 7/1273 92/164
2,487,512 A * 11/1949 Berger ..... F16J 10/02 220/621
2,748,801 A * 6/1956 McCuistion ..... F15B 1/24 138/31
3,347,043 A * 10/1967 Freese ..... F15B 7/10 60/546
3,408,731 A * 11/1968 Mercier ..... F15B 1/12 29/511
4,002,107 A 1/1977 Erickson et al.
4,073,219 A 2/1978 Bimba
4,180,274 A * 12/1979 Tucek ..... F15B 15/1438 277/500
4,878,419 A * 11/1989 Vick ..... F15B 15/1438 92/163
4,973,027 A * 11/1990 Casas ..... F15B 15/1419 254/93 R (Continued)

FOREIGN PATENT DOCUMENTS

DE 4002558 C2 6/1995
FR 2465109 A1 7/1982

(Continued)

OTHER PUBLICATIONS

Written Opinion and International Search Report for INternational Patent Appln No. PCT/US2021/024264, dated Jun. 16, 2021 (11 pgs).

*Primary Examiner* — Thomas E Lazo
(74) *Attorney, Agent, or Firm* — von Briesen & Roper, s.c.

(57) ABSTRACT

A hydraulic cylinder may include a cylindrical tube, a piston head with a piston rod disposed within the cylindrical tube, a cylinder head secured in one tube end of the cylindrical tuba and having the piston rod extending through a piston rod opening, and a cylinder cap with a cap sealing portion inserted in the opposite tube end of the cylindrical tube. The tube end is crimped down onto the cap sealing portion so that a tube material of the cylindrical tube is disposed within the plurality of annular cap grooves in the cap seal portion to retain the cylinder cap. The cylinder head may have a similar plurality of annular head grooves, with the corresponding tube end being crimped down onto the cylinder head.

17 Claims, 8 Drawing Sheets

(56) References Cited

U.S. PATENT DOCUMENTS

| | | | | | |
|---|---|---|---|---|---|
| 5,311,910 | A * | 5/1994 | Hasegawa | F15B 1/24 | 138/30 |
| 5,680,808 | A * | 10/1997 | Day | F15B 15/1447 | 92/168 |
| 5,941,509 | A * | 8/1999 | Avesian | F16F 9/0463 | 267/64.27 |
| 6,439,103 | B1 * | 8/2002 | Miller | F01B 29/00 | 92/128 |
| 6,460,571 | B1 * | 10/2002 | Rajabi | F16L 55/053 | 138/109 |
| 7,089,848 | B2 * | 8/2006 | McCrary | F15B 15/1414 | 92/165 PR |
| 7,614,133 | B2 * | 11/2009 | Candelieri | B21D 39/04 | 29/508 |
| 2008/0314113 | A1 * | 12/2008 | Minoguchi | F15B 15/1438 | 72/370.06 |
| 2012/0160090 | A1 * | 6/2012 | Kato | F15B 15/1461 | 92/87 |

FOREIGN PATENT DOCUMENTS

| | | | |
|---|---|---|---|
| JP | 49138238 | U | 11/1974 |
| WO | 2005111432 | A1 | 11/2005 |

* cited by examiner

CRIMP RETAINED HYDRAULIC CYLINDER HEAD AND CAP

TECHNICAL FIELD

The present disclosure relates generally to hydraulic cylinders for a work machine and, more particularly, to hydraulic cylinders having heads and caps retained via crimping operations.

BACKGROUND

Many operator-driven work machines have been developed for performing excavation operations on work surfaces, such as asphalt pavers, backhoe loaders, cold planers, compactors, bulldozers, drills, excavators, material handlers, motor graders, skid steer and wheel loaders, and the like. Generally, these work machines include one or more work implements mounted on a tractor or other machine body that is moveable along the ground on wheels or tracks. Stabilizing legs may also be included to hold the work machine in place while the operator is utilizing the implement. Movement of the implements and the stabilizer legs may be controlled using actuators such as hydraulic cylinders.

Hydraulic cylinders for controlling elements in work machines are known in the art. For example, International Publ. No. WO2005111432, that published on Nov. 24, 2005, entitled "Hydraulic Cylinder," discloses a hydraulic cylinder having a tube provided with a cap attached to a first axial end portion of the tube and a head attached to the other axial end portion of the tube. A piston is slidable axially within the tube and is arranged to seal against the inside surface of the tube as it slides. The piston has a rod attached thereto which passes through and seals against the head as it moves with the piston. Conduits are provided to be connected, in use, to sources of hydraulic fluid via suitable supply lines to control fluid pressure on at least one side of the piston within the tube to control axial movement of the piston within the tube. End portions of the tube are mechanically formed into engagement with at least one of the cap and the head to fix the tube in a permanent and fluid tight manner thereto.

Current configurations of hydraulic cylinders may retain heads in the ends of the tubes via torque or retaining rings providing interference fits, and caps may be retained via meshing threads, retaining rings or welds. Such attachment mechanisms may not provide sufficient strength to retain the heads and caps, and may render the hydraulic cylinders time consuming and costly to manufacture.

SUMMARY OF THE DISCLOSURE

In one aspect of the present disclosure, a hydraulic cylinder is disclosed. The hydraulic cylinder may include a cylindrical tube having a tube inner surface, a tube outer surface, a tube first end, a tube second end opposite the tube first end, and a first fluid port proximate the tube first end, a piston head disposed within the cylindrical tube, a piston rod connected to the piston head and extending outward from the cylindrical tube through the tube second end, a cylinder head having a piston rod opening receiving the piston rod and having the piston rod slidable therethrough, wherein the cylinder head is inserted into and engaged by the tube second end of the cylindrical tube to retain the cylinder head therein, and a cylinder cap having a cap sealing portion with a cylindrical shape and a cylinder attachment portion. The cap sealing portion may have a plurality of annular cap grooves defined in a sealing portion outer surface, the cap sealing portion may be inserted into the tube first end, and the tube outer surface proximate the tube first end is crimped down onto the cap sealing portion so that a tube material of the cylindrical tube at the tube inner surface proximate the tube first end is disposed in the plurality of annular cap grooves to retain the cap sealing portion within the tube first end and seal the tube first end of the cylindrical tube.

In another aspect of the present disclosure, a method for manufacturing a hydraulic cylinder is disclosed. The method for manufacturing a hydraulic cylinder may include forming a plurality of annular cap grooves in a sealing portion outer surface of a cap sealing portion of a cylinder cap, inserting the cap sealing portion into a tube first end of a cylindrical tube of the hydraulic cylinder, and crimping a tube outer surface of the cylindrical tube proximate the tube first end down onto the cap sealing portion so that a tube material of the cylindrical tube at a tube inner surface proximate the tube first end is disposed in the plurality of annular cap grooves to retain the cap sealing portion within the tube first end and seal the tube first end of the cylindrical tube.

In a further aspect of the present disclosure, a hydraulic cylinder is disclosed. The hydraulic cylinder may include a cylindrical tube having a tube inner surface, a tube outer surface, a tube first end, a tube second end opposite the tube first end, and a first fluid port proximate the tube first end, a piston head disposed within the cylindrical tube, a piston rod connected to the piston head and extending outward from the cylindrical tube through the tube second end, and a cylinder head having a piston rod opening receiving the piston rod and having the piston rod slidable therethrough. The cylinder head may have a plurality of annular head grooves defined in a head outer surface, the cylinder head is inserted into the tube second end, and the tube outer surface proximate the tube second end is crimped down onto the cylinder head so that a tube material of the cylindrical tube at the tube inner surface proximate the tube second end is disposed in the plurality of annular head grooves to retain the cylinder head within the tube second end and seal the tube second end of the cylindrical tube.

Additional aspects are defined by the claims of this patent.

DETAILED DESCRIPTION

Figure 1:
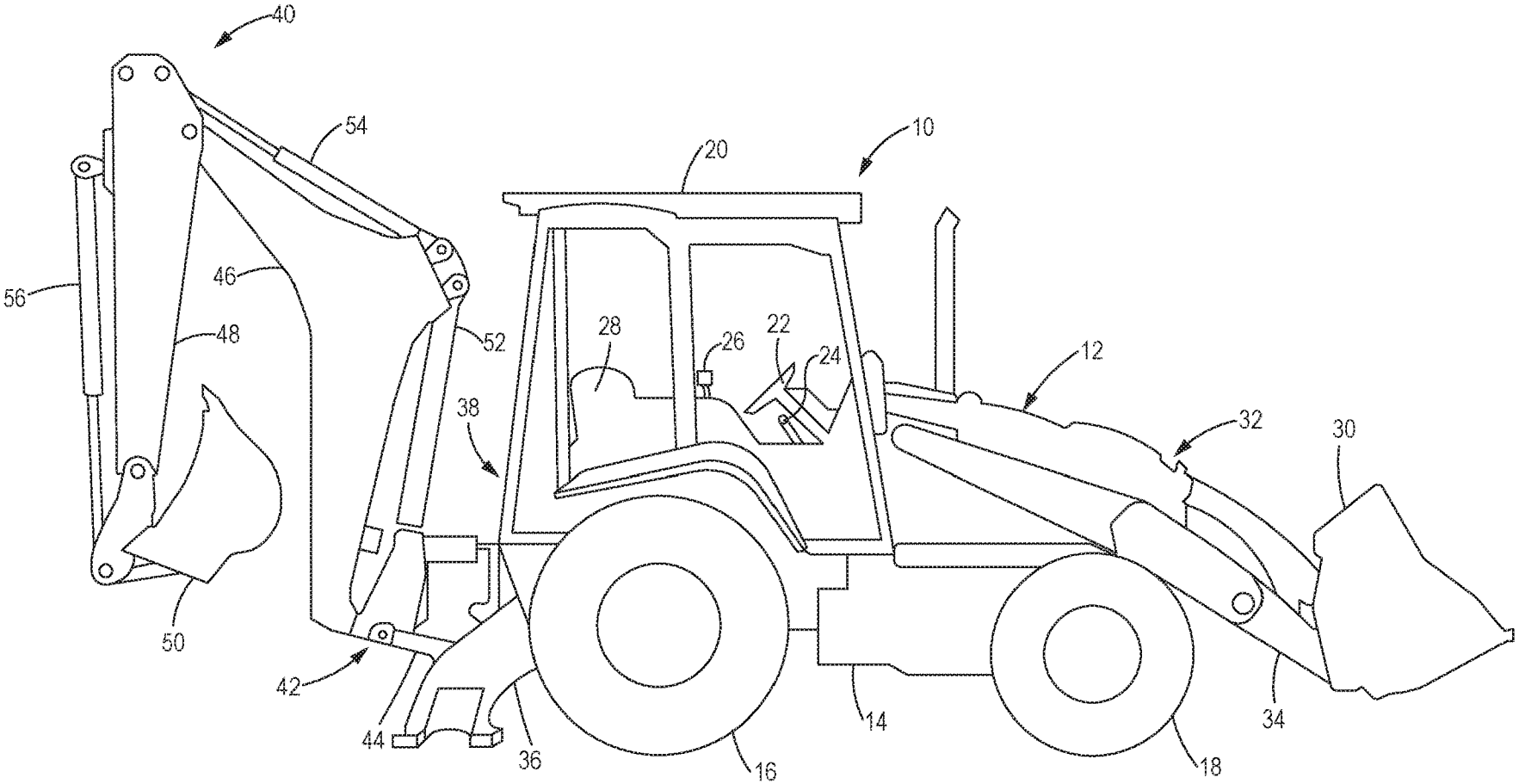
FIG. 1 is a side view of an exemplary work machine in which hydraulic cylinders in accordance with the present disclosure may be implemented.

FIG. 1 illustrates an exemplary work machine 10 in the form of a backhoe loader in which hydraulic cylinders in accordance with the present disclosure may be implemented. The work machine 10 may include a machine body 12 having a chassis 14. The machine body 12 may include ground engaging elements, such as a pair of rear wheels 16 and a pair of front wheels 18. It should be understood that, instead of wheels 16, 18, the machine body 12 could be provided with a pair of tracks or other structure to permit transportation of the work machine 10 over a work surface. The work machine 10 may also include an operator cab 20 or other suitable facilities to accommodate an operator (not shown). The operator cab 20 may include suitable controls for driving the work machine 10, such as a steering wheel 22 and a gear shift lever 24. The operator cab 20 may also have controls for controlling the operation of the implements of the work machine 10, such as joysticks 26 mounted on an operator seat 28 that enable the operator to interface with a control system (not shown) of the work machine 10.

The work machine 10 may include a loader bucket 30 at a first end 32 of the machine body 12, and a suitable operating linkage 34 for manipulation of the loader bucket 30, with movement of the loader bucket 30 and the operating linkage 34 being controlled by hydraulic cylinders (not shown). The work machine 10 may further include a pair of outriggers or stabilizers 36 mounted adjacent a second end 38 of the machine body 12. The outriggers 36 may be hydraulically controlled by hydraulic cylinders (not shown) in a relatively conventional manner to swing between a stored position and an extended position in which they contact the ground to stabilize the work machine 10 during operation of the implements.

The work machine 10 may also include an excavating assembly 40, for example, a backhoe mechanism, at the second end 38 of the machine body 12. The backhoe mechanism 40 may include a suitable swing assembly 42 for permitting the backhoe mechanism 40 to swing about a pivot from one side of the machine body 12 to the other. The swing assembly 42 may move under the control of one or more hydraulic cylinders 44 and may serve to move the backhoe mechanism 40 from an excavating position to a dumping position.

The backhoe mechanism 40 may include a boom 46 having a first end pivotally mounted adjacent the machine body 12 for movement in a generally vertical plane. A stick 48 may have a first end pivotally mounted adjacent a second end of the boom 46 for movement in the same generally vertical plane in which the boom 46 may move. An excavating implement in the form of a bucket 50 may be pivotally mounted at a second end of the stick 48 for pivotal movement in the same generally vertical plane in which the boom 46 and the stick 48 may move. The bucket 50 may be a relatively conventional backhoe bucket. The boom 46, the stick 48 and the bucket 50 may be pivotally moved under the control of hydraulic cylinders 52, 54, 56, respectively.

Figure 2:
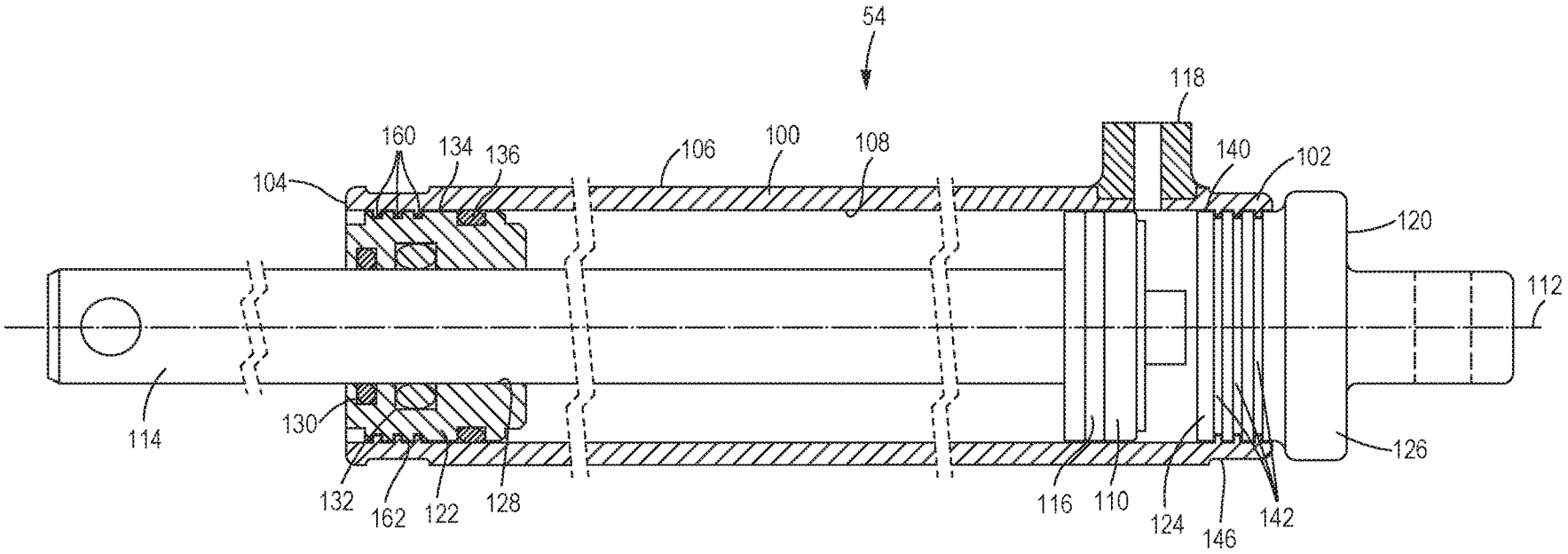
FIG. 2 is partial cross-sectional side view of an embodiment of a hydraulic cylinder in accordance with the present disclosure.

FIG. 2 is a partial cross-sectional side view of the hydraulic cylinder 54 for the stick 48 illustrating the hydraulic cylinder configuration and manufacturing in accordance with the present disclosure. While the hydraulic cylinder 54 is illustrated and described in detail herein, those skilled in the art will understand that the hydraulic cylinders 52, 56 or any other hydraulic cylinders may be configured in a similar manner. The hydraulic cylinder 54 may include a hollow cylindrical tube 100 having a tube first end 102 and a tube second end 104 opposite the tube first end 102. A tube outer surface 106 of the cylindrical tube 100 may have a tube outer diameter that may be fixed or variable as discussed further below. A tube inner surface 108 may have a tube inner diameter that is dimensioned to accommodate the components disposed therein and manufacturing processes as discussed further below.

The hydraulic cylinder 54 further includes a piston head 110 disposed within the cylindrical tube 100. The piston head 110 has a piston head outer diameter that is smaller than the tube inner diameter to allow the piston head 110 to slide back and forth along a tube longitudinal axis 112 within the cylindrical tube 100. An annular seal 116 around the piston head 110 may engage the tube inner surface 108 to fluidly isolate the cavities on either side of the piston at 110 from each other by preventing hydraulic fluid within the cylindrical tube 100 from flowing around the piston head 110. A piston rod 114 connected to one side of the piston head 110 may extend out of the cylindrical tube 100 through the tube second end 104. The piston rod 114 may be configured to be directly or indirectly coupled to a component of the work machine 10, such as the stick 48, that will be manipulated by the hydraulic cylinder 54 by extending and retracting the piston rod 114. Hydraulic fluid may be provided to and drained from the interior of the cylindrical tube 100 via a first fluid port 118 proximate the tube first end 102. The first fluid port 118 may be selectively fluidly connected to a pressurized fluid source and a low pressure reservoir by a control valve (not shown) to control the operation of the hydraulic cylinder 54 to extend and retract the piston rod 114. The hydraulic cylinder 54 may also include a second fluid port (not shown) proximate the tube second end 104 to regulate fluid flow and fluid pressure in both cavities in the manner known in the art.

A cylinder cap 120 closes off the tube first end 102 of the cylindrical tube 100, and a cylinder head 122 closes off the tube second end 104. The cylinder cap 120 may include a cylindrical cap sealing portion 124 and a cylinder attachment portion 126. The cap sealing portion 124 is disposed within the tube first end 102 and engaged by the tube inner surface 108 to retain the cylinder cap 120 and seal the tube first end 102 as described further below. If necessary, the cap sealing portion 124 and the tube inner surface 108 may be configured with a seal (not shown) there between as known in the art to further prevent leakage of hydraulic fluid. The cylinder attachment portion 126 is disposed external to the cylindrical tube 100 and is configured for attachment to a structure of the work machine 10 such as, for example, the boom 46. With the cylinder attachment portion 126 attached to the boom 46 and the piston rod 114 operatively connected to the stick 48, extension and retraction of the piston rod 114 causes the stick 48 to rotate about a pivot connection relative to the boom 46.

The cylinder head 122 may include a piston rod opening 128 receiving the piston rod 114 so that the piston rod 114 is slidable therein. Seals 130, 132 may be provided to prevent leakage of hydraulic fluid between the piston rod 114 and the piston rod opening 128. The cylinder head 122 is disposed within the cylindrical tube 100 at the tube second end 104. A head outer surface 134 is engaged by the tube inner surface 108 at the tube second end 104 to retain the cylinder head 122 in place therein. If necessary, a seal 136 is provided between the tube inner surface 108 and the head outer surface 134 to prevent leakage of hydraulic fluid around the cylinder head 122.

The hydraulic cylinder 54 as illustrated and described herein is a single acting hydraulic cylinder with a single piston rod 114. Those skilled in the art will understand that crimp retention in accordance with the present disclosure may be implemented in other types of hydraulic cylinders, such as double acting hydraulic cylinders having piston rods 114 extending from either end 102, 104 of the cylindrical tube 100. Such double acting hydraulic cylinders may be used in steering systems among other applications, and include a second piston rod 114 attached to the piston head 110 and extending out of the tube first end 102. The cylinder cap 120 may be replaced by a second cylinder head 122 through which the second piston rod 114 extends and that is attached at the tube second end 104 in a similar manner as described herein. The double acting hydraulic cylinder may include a single fluid port 118, or have fluid ports 118 at either end 102, 104 as necessary for a particular implementation. Further alternative configurations of single and double acting hydraulic cylinders implementing crimp retention in accordance with the present disclosure are contemplated by the inventors.

Figure 3:
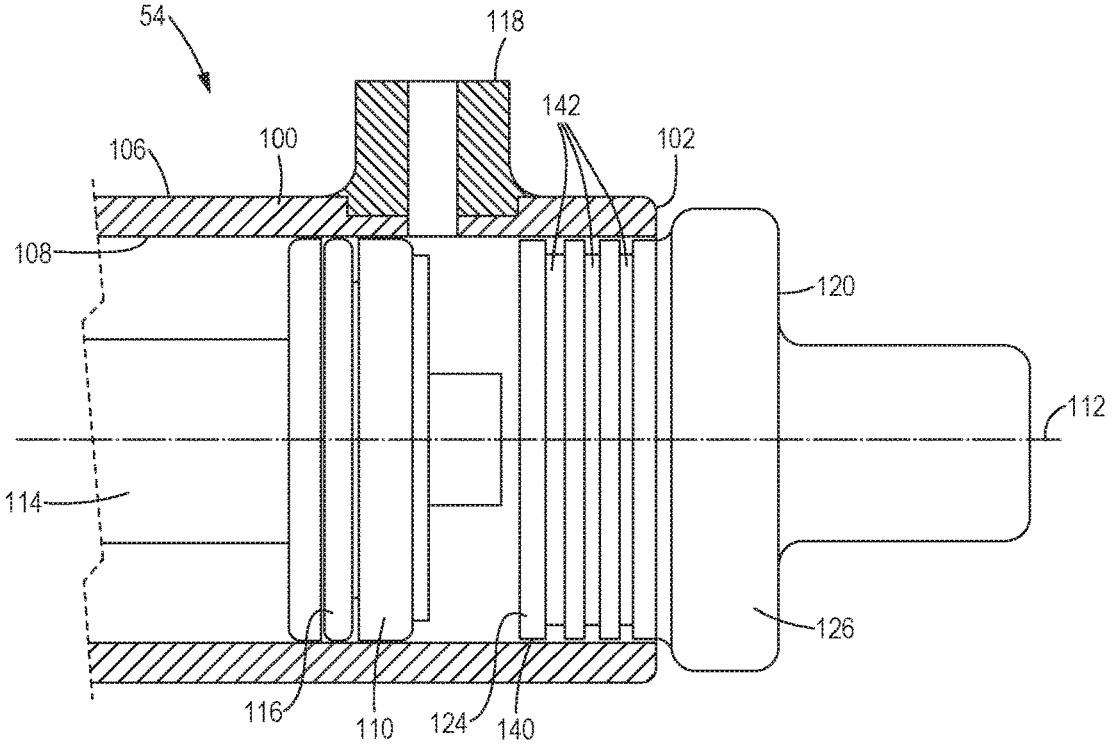
FIG. 3 is an enlarged partial cross-sectional side view of a tube first end of a cylindrical tube and a cylinder cap of the hydraulic cylinder of FIG. 2 prior to crimping the tube first end.

FIG. 3 illustrates an enlarged view of the tube first end 102 and the cylinder cap 120 before the components are secured together by a crimping force. The cap sealing portion 124 has a sealing portion outer surface 140 with a sealing portion outer diameter that is less than the tube inner diameter at the tube first end 102 to allow for insertion through the tube first end 102. The cap sealing portion 124 further includes a plurality of annular cap grooves 142 defined in the sealing portion outer surface 140. In the illustrated embodiment, the annular cap grooves 142 are recessed within the sealing portion outer surface 140 and have a constant groove width so that the annular cap grooves 142 have rectangular or square cross-sections.

Figure 3A:
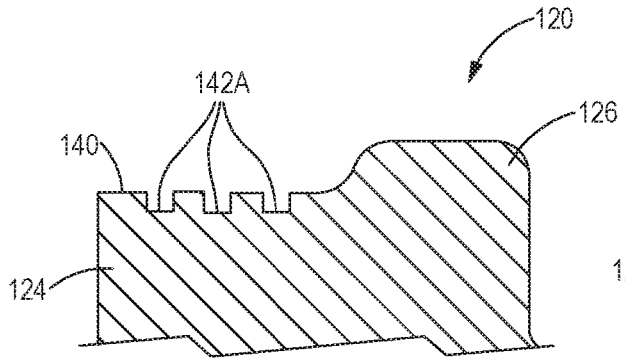
FIGS. 3A-3E are enlarged cross-sectional views of a portion of the cylinder cap of FIG. 3 illustrating alternative annular cap groove geometries.
Figure 3B:
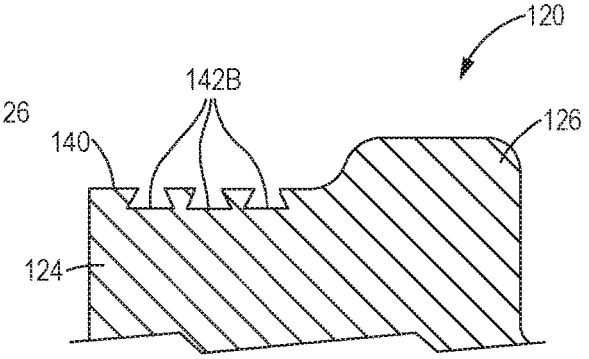
Figure 3C:
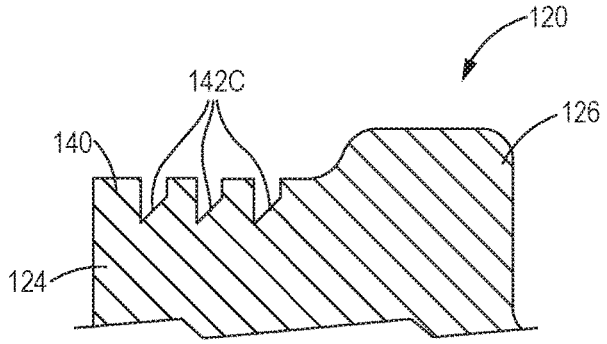
Figure 3D:
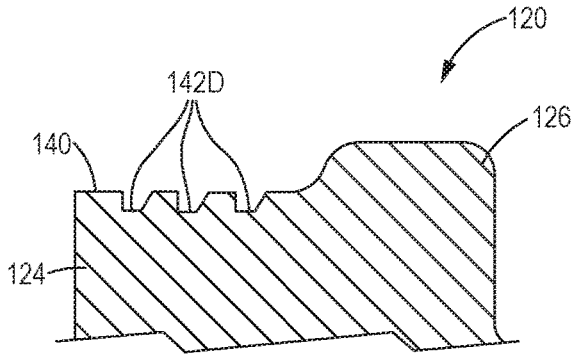
Figure 3E:
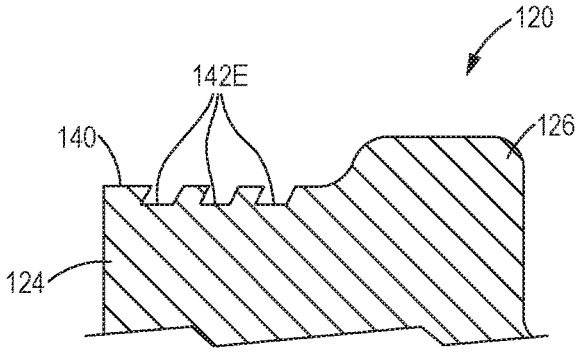

In alternative embodiments, the annular cap grooves 142 may have other cross-sectional shapes. FIGS. 3A-3E are enlarged cross-sectional views of a portion of the cap sealing portion 124 illustrating geometries of several alternative groove configurations. FIG. 3A illustrates rectangular cap grooves 142A as illustrated and described in relation to FIG. 3. In FIG. 3B, annular cap grooves 142B may have dovetail shapes where the cap groove width increases as the annular cap grooves 142B extend inward from the sealing portion outer surface 140. FIG. 3C illustrates annular cap grooves 142C that are deeper proximate inward edges of the annular cap grooves 142C. This allows more tube material of the cylindrical tube 100 to be disposed at the locations that bear the hydraulic and structural forces tending to push or pull the cylinder cap 120 out of the tube first end 102 of the cylindrical tube 100 after the tube first end 102 is crimped down onto the cap sealing portion 124 as described further below. Annular cap grooves 142D as shown in FIG. 3D have outward edges that slope toward the inward edges to direct the tube material toward the inward edges during crimping. FIG. 3E illustrates annular cap grooves 142E having inward edges similar to the dovetail cap grooves 142B of FIG. 3B and sloped outward edges similar to the annular cap grooves 142D of FIG. 3D. Further alternative cross-sectional shapes for the annular cap grooves 142 are contemplated that will create the desired engagement between the tube inner surface 108 and the sealing portion outer surface 140 as discussed below.

Figure 4:
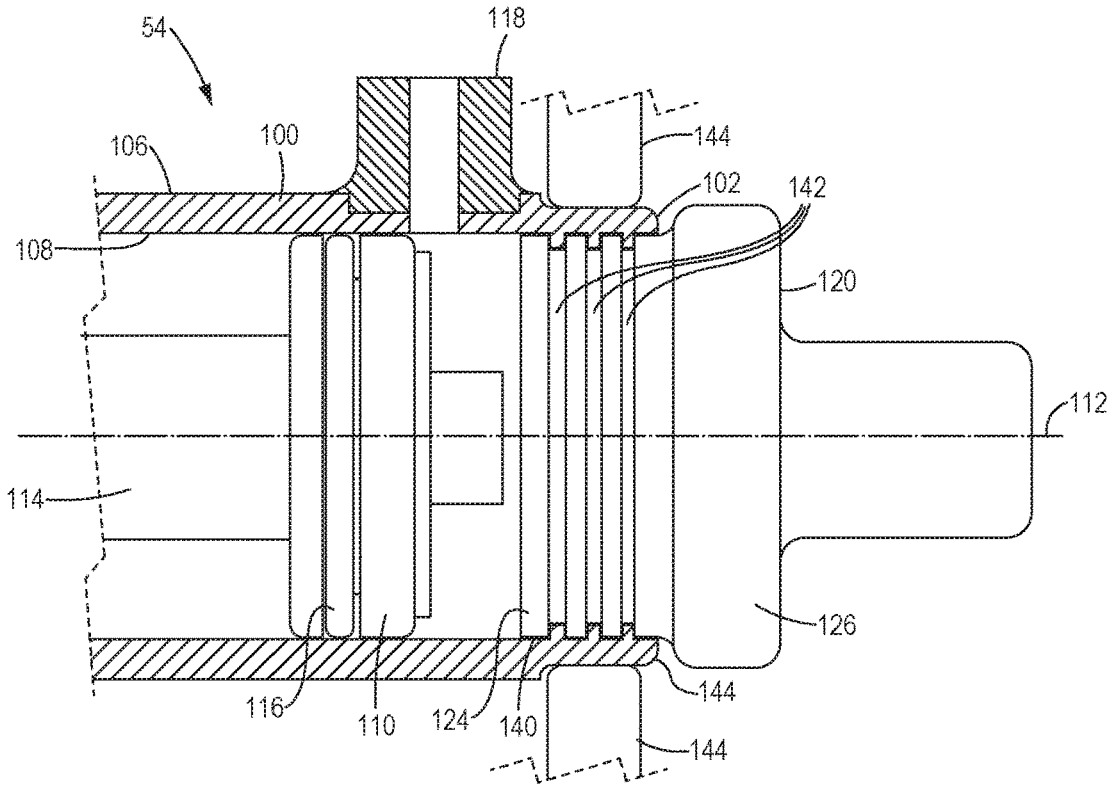
FIG. 4 is the enlarged partial cross-sectional side view of the tube first end and the cylinder cap of FIG. 3 after crimping the tube first end.

With the cap sealing portion 124 inserted, the tube first end 102 may be crimped to bring the tube inner surface 108 and the sealing portion outer surface 140 into engagement. Referring to FIG. 4, a crimping force may be applied to the tube outer surface 106 proximate the tube first end 102 by an appropriate crimping device. In the illustrated embodiment, crimping jaws 144 of a hydraulic crimping machine may engage the tube outer surface 106 and apply force in the radial direction to press the corresponding portion of the cylindrical tube 100 down onto the cap sealing portion 124. As the crimping force compresses the cylindrical tube 100, a tube material at the tube inner surface 108 may be pressed into the annular cap grooves 142. The crimping force may also create crimping indentations 146 in the tube outer surface 106 under the crimping jaws 144. Appropriate to materials may include steel, stainless steel, aluminum or other materials that are sufficiently malleable to deform as shown under the crimping force and yet are strong enough to handle the forces and operating hydraulic pressures encountered during operation of the hydraulic cylinder 54. The flow of the tube material into the annular cap grooves 142 creates an interference fit that prevents the cap sealing portion 124 from being separated from the tube first end 102. In some implementations, a hydraulic seal may be formed between the tube inner surface 108 and the sealing portion outer surface 140. In other implementations, it may be necessary to include a separate sealing device, such as an O-ring (not shown), to prevent leakage of hydraulic fluid from the tube first end 102.

Figure 5:
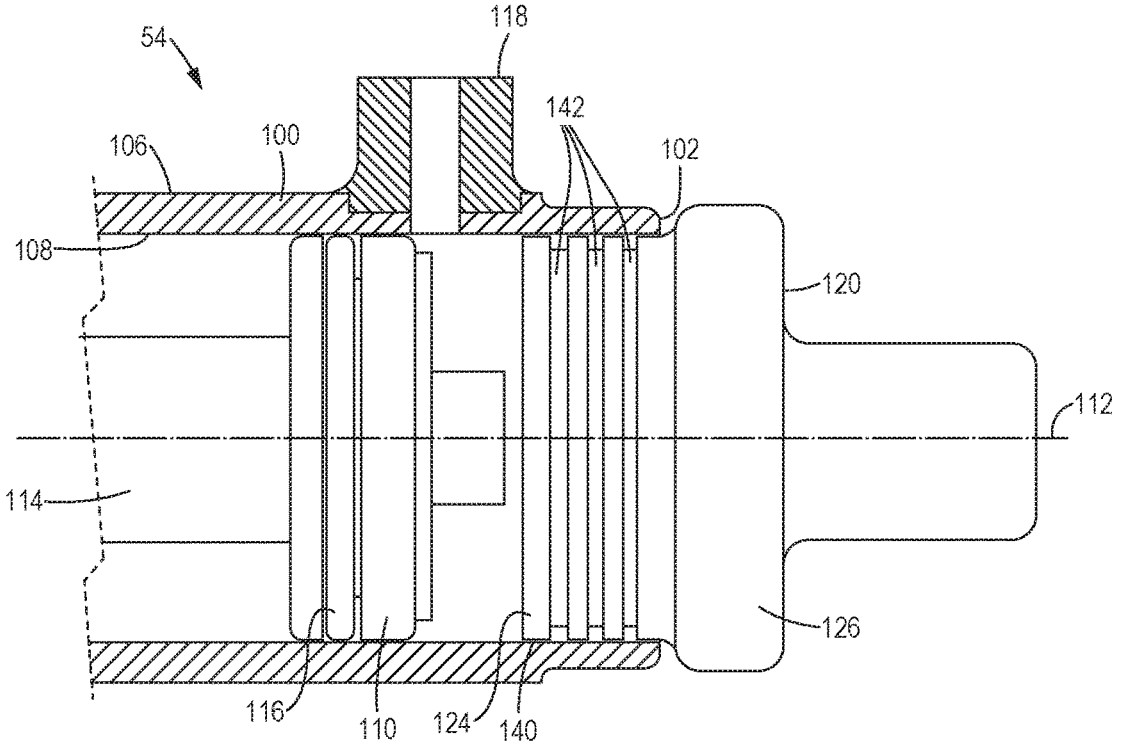
FIG. 5 is an enlarged partial cross-sectional side view of the tube first end and the cylinder cap of an alternative embodiment of a hydraulic cylinder in accordance with the present disclosure prior to crimping the tube first end.

Further variations of the embodiment of FIGS. 3 and 4 are contemplated and may be implemented in hydraulic cylinders in us accordance with the present disclosure. FIG. 5 illustrates an embodiment where a portion of the cylindrical tube 100 proximate the tube first end 102 has a smaller tube outer diameter than the remainder of the cylindrical tube 100. The decreased thickness of the cylindrical tube 100 in this area will facilitate deformation as described above under the application of the crimping force.

Figure 6:
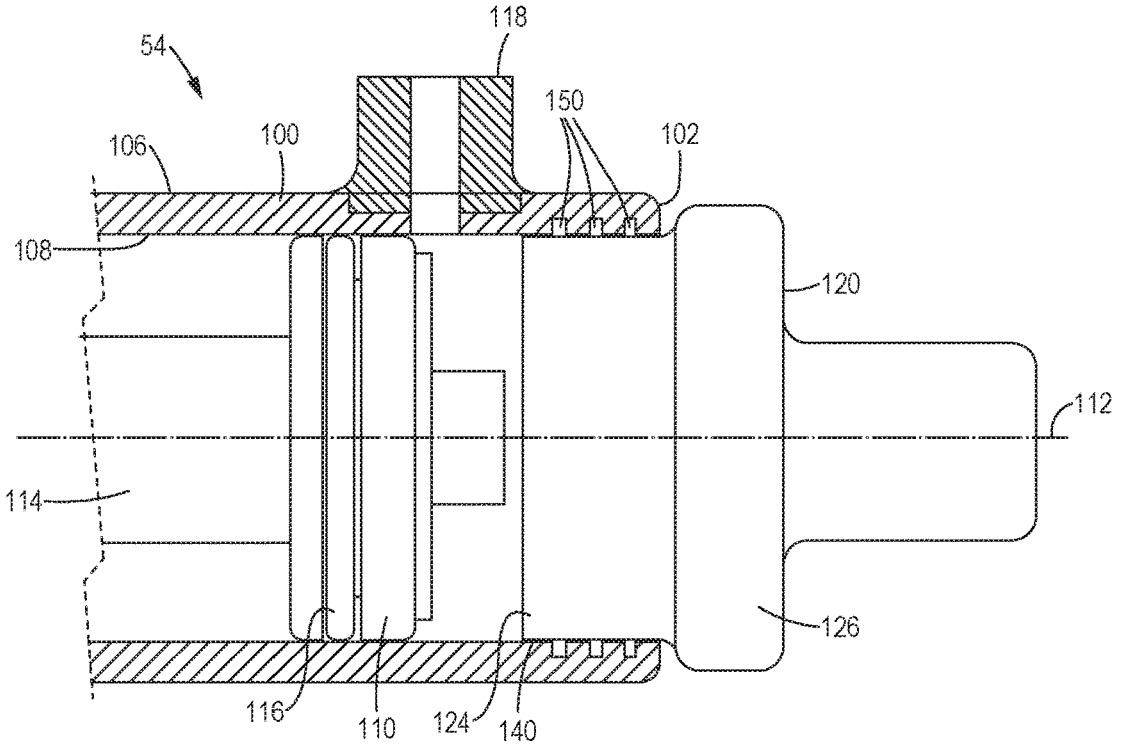
FIG. 6 is an enlarged partial cross-sectional side view of the tube first end and the cylinder cap of a further alternative embodiment of a hydraulic cylinder in accordance with the present disclosure prior to crimping the tube first end.

FIG. 6 illustrates a further alternative embodiment where the surfaces 108, 140 are essentially reversed. A plurality of annular tube grooves 150 are defined in the tube inner surface 108 while the sealing portion outer surface 140 may omit the annular cap grooves 142 of the previous embodiments. As the crimping force compresses the cylindrical tube 100 at the tube first end 102, a cap material proximate the sealing portion outer surface 140 will be pressed into the annular tube grooves 150 in a similar manner as described above. Consequently, the cap material in this embodiment should have a similar malleability as the tube material described above.

Figure 7:
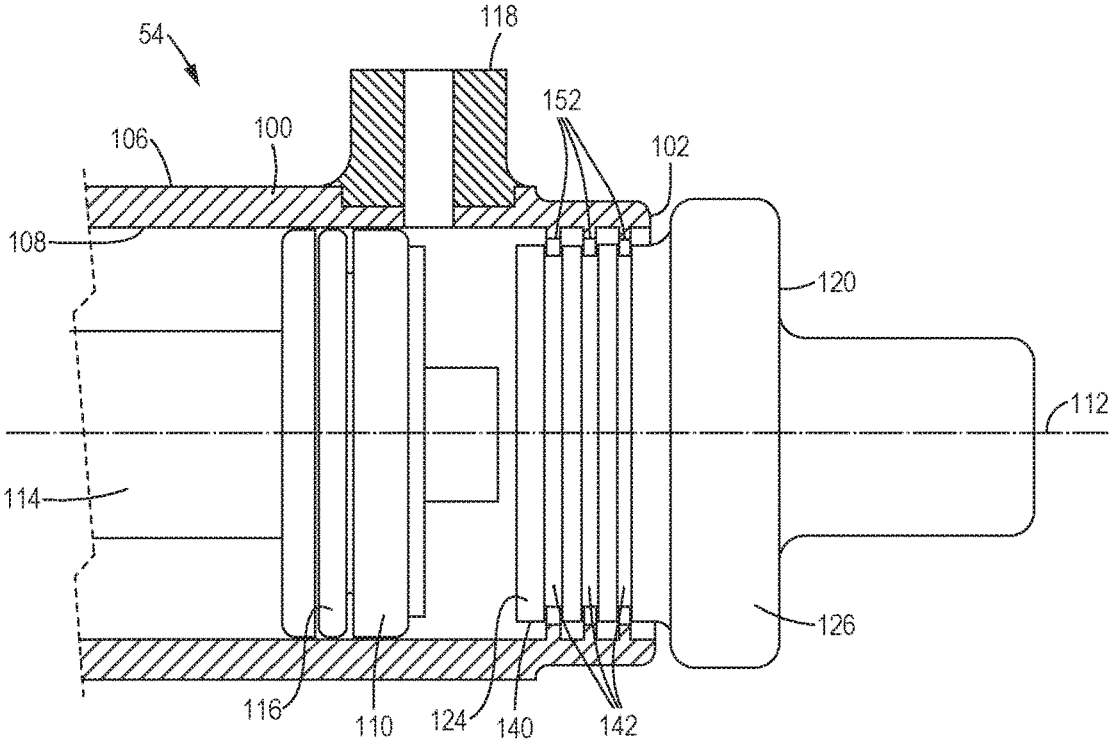
FIG. 7 is an enlarged partial cross-sectional side view of the tube first end and the cylinder cap of another embodiment of a hydraulic cylinder in accordance with the present disclosure prior to crimping the tube first end.

FIG. 7 illustrates a further alternative embodiment where both the tube inner surface 108 and the sealing portion outer surface 140 are configured with features that will mate when the crimping force is applied. The sealing portion outer surface 140 may include a plurality of annular cap grooves 142 is described above. The tube inner surface 108 may have a plurality of annular tube ribs 152 that extend radially inward from the tube inner surface 108 proximate tube first end 102. The annular tube ribs 152 have a rib inner diameter that is greater than the sealing portion outer diameter before the crimping force is applied to allow for insertion of the cap sealing portion 124. When the cap sealing portion 124 is inserted in the tube first end 102, the annular cap grooves 142 are aligned with corresponding ones of the annular tube ribs 152. After alignment, the crimping force is applied to force the annular tube ribs 152 radially inward into the corresponding annular cap grooves 142 to secure the cylinder cap 120. In alternative embodiments, the mechanism may be reversed. The tube inner surface 108 may have the annular tube grooves 150 as discussed above, and the sealing portion outer surface 140 may have a plurality of annular cap ribs extending radially outward. The annular tube grooves 150 and the annular cap ribs may be aligned as discussed above so that the annular tube grooves 150 receive the annular cap ribs when the crimping force is applied.

Figure 8:
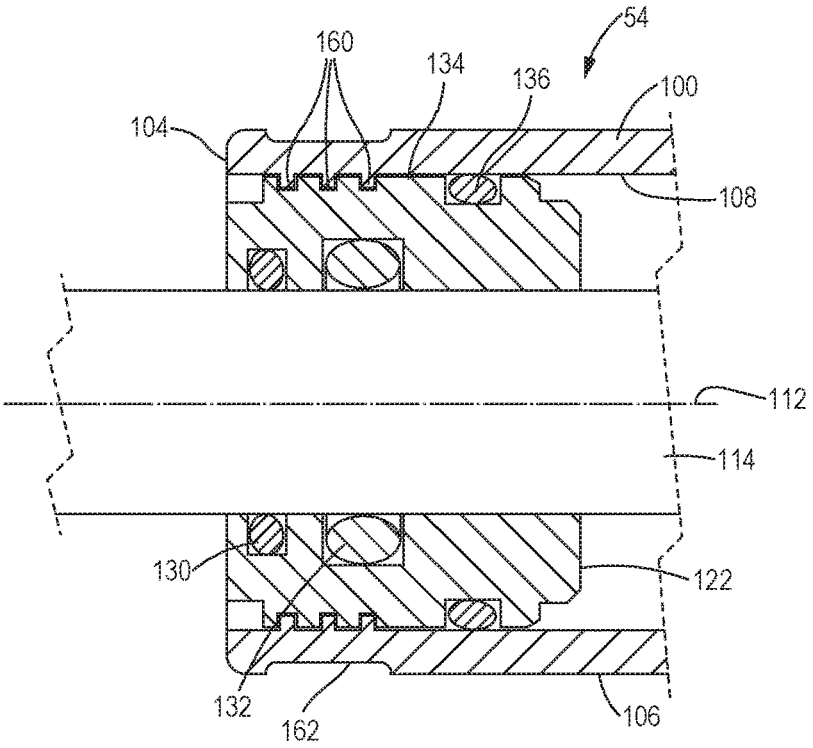
FIG. 8 is an enlarged partial cross-sectional side view of a tube second end of the cylindrical tube and a cylinder head of the hydraulic cylinder of FIG. 2 after crimping the tube second end.

In addition to, or as an alternative to, permanently securing the cylinder cap 120 to the cylindrical tube 100, the cylinder head 122 may be secured in a similar manner as illustrated and described above. As shown in FIG. 8, the head outer surface 134 may have a plurality of annular head grooves 160 formed therein. The tube material at the tube inner surface 108 may be pressed into the annular head grooves 160 when the crimping force is applied and crimping indentations 162 are formed. The annular head grooves 160 are exemplary, and any other combinations of connection elements as discussed above in relation to FIGS. 3-7 for the cylinder cap 120 may be implemented at the cylinder head 122 and the tube second end 104 of the cylindrical tube 100, such as constant or increasing head groove widths, smaller tube outer diameters, annular tube grooves, annular head or tube ribs, and the like.

Figure 9:
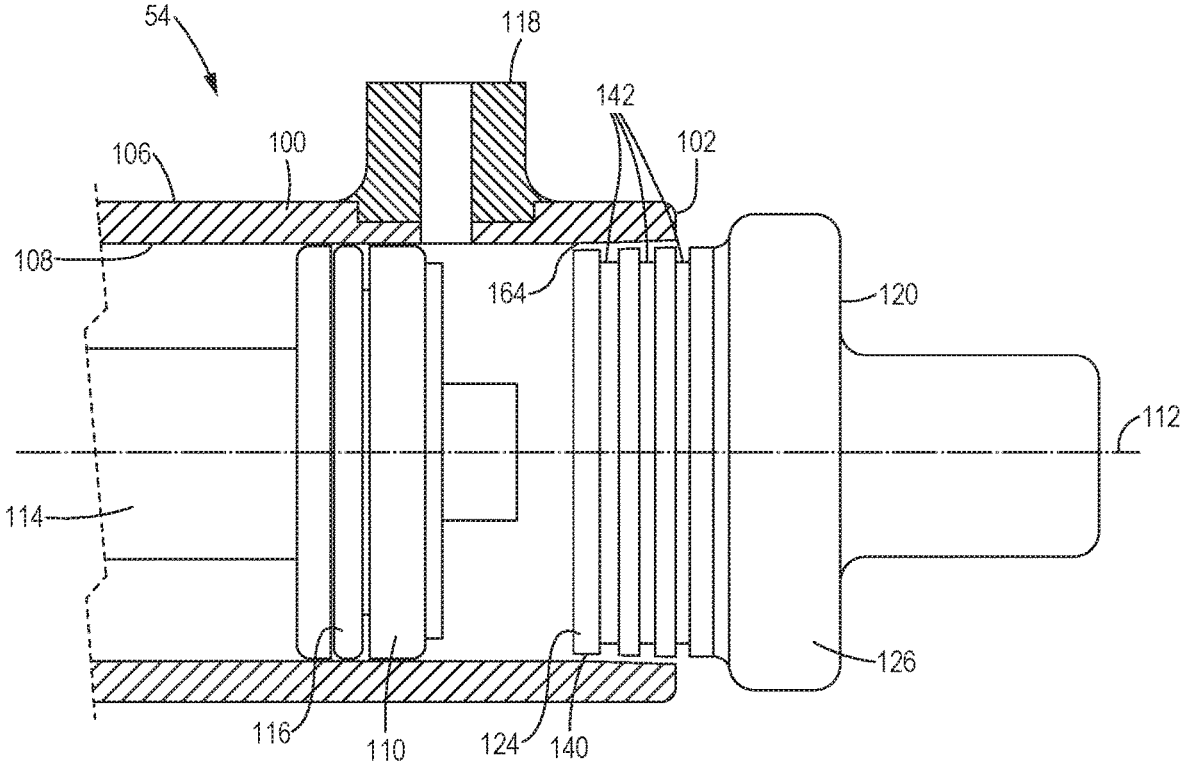
FIG. 9 is an enlarged partial cross-sectional side view of the tube first end and the cylinder cap of yet another embodiment of a hydraulic cylinder in accordance with the present disclosure prior to crimping the tube first end.

FIG. 9 illustrates a further alternative embodiment of the cylindrical tube 100 and the cylinder cap 120 that may facilitate both insertion of the cap sealing portion 124 into the tube first end 102 and crimping of the tube first end 102 of the cylindrical tube 100. The tube second end 104 and the cylinder head 122 may be configured in a similar manner. In this embodiment, the cap sealing portion 124 may be tapered so that the sealing portion outer diameter of the sealing portion outer surface 140 decreases as the cap sealing portion 124 extends away from the cylinder attachment portion 126. A draft angle of the taper may be as shallow or as steep as necessary for a particular implementation, and is approximately 2° as illustrated in FIG. 9. The tube first end 102 of the cylindrical tube may have a complimentary tube tapered portion 164 so that a tube inner surface inner diameter increases and, correspondingly, a cylindrical tube wall thickness decreases as the tube inner surface 108 extends from an interior of the cylindrical tube toward the tube first end 102. The draft angle of the tube inner surface 108 may be greater than, less than or approximately equal to the draft angle of the cap sealing portion 124 as necessary to ensure a secured and sealed fit between the components after the crimping force is applied.

INDUSTRIAL APPLICABILITY

Figure 10:
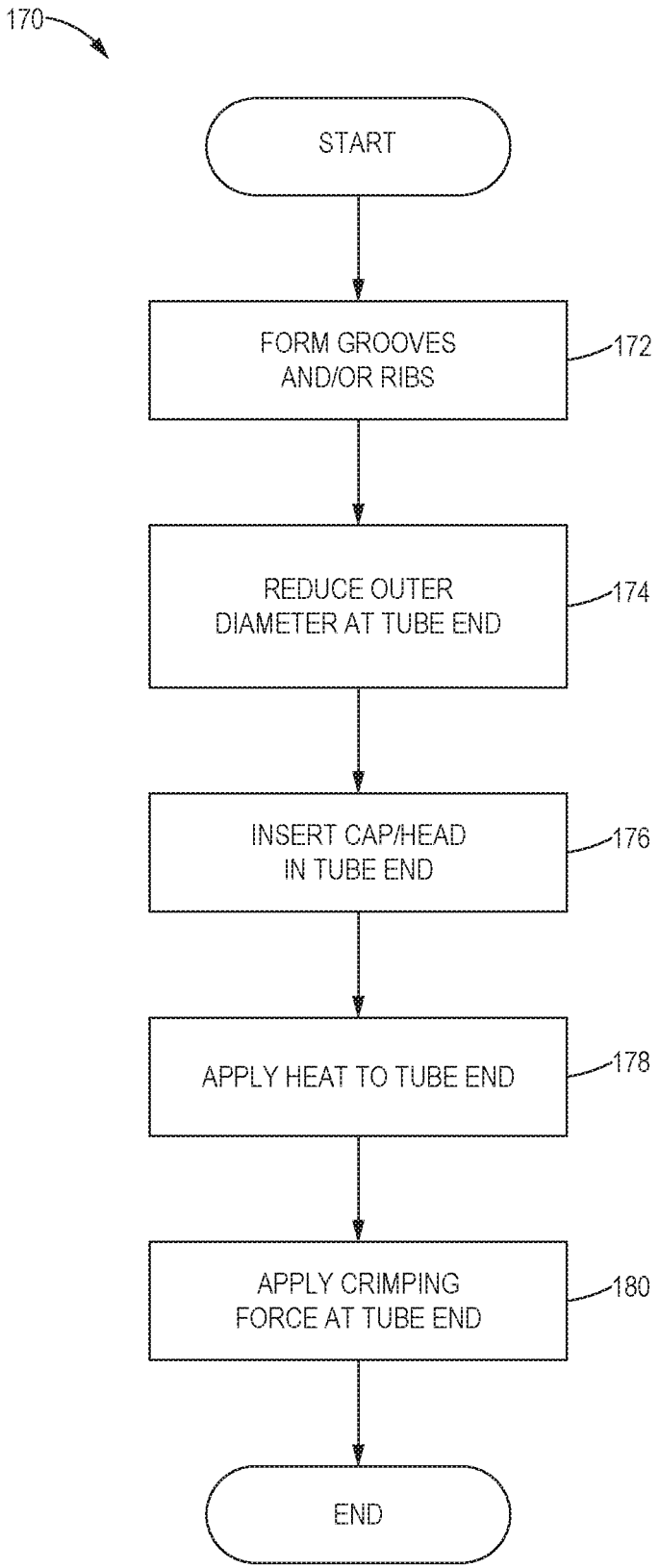
FIG. 10 is a flow diagram of an exemplary hydraulic cylinder manufacturing routine in accordance with the present disclosure for the hydraulic cylinder of FIG. 2.

FIG. 10 illustrates an exemplary hydraulic cylinder manufacturing routine 170 for hydraulic cylinders 54 in accordance with the present disclosure. The manufacturing routine 170 may begin at a block 172 by forming annular grooves and/or annular ribs in the surfaces 108, 134 and/or 140 depending on how the cylinder cap 120 and the cylinder head 122 will be secured to the cylindrical tube 100. The grooves or ribs may be formed in the surfaces 108, 134, 140 as the corresponding components are formed, such as during casting or extrusion processes. Alternatively, the grooves or ribs may be machined into the components after initial fabrication. Prior to, contemporaneous with, or after forming the annular tube grooves 150 or the annular tube ribs 152 in the tube inner surface 108 at the block 172, control may pass to a block 174 where the tube outer diameter of the tube outer surface 106 is reduced proximate the tube first end 102, the tube second end 104, or both. As with the annular tube grooves 150 or the annular tube ribs 152, the tube outer diameter may be reduced during initial fabrication of the cylindrical tube 100 or may be formed by machining the tube outer surface 106 after the cylindrical tube 100 is cast or extruded.

Once the structures for the connections of the cylinder cap 120 and/or the cylinder head 122 are completed at the blocks 172, 174, control may pass to a block 176 where the cylinder cap 120 and/or the cylinder head 122 are inserted into the respective tube ends 102, 104. As illustrated herein, the seal portion inner diameter is less than the tube inner diameter to facilitate insertion of the cap sealing portion 124. However, in alternative embodiments the seal portion inner diameter may be slightly larger than the tube inner diameter to create an interference fit between the components. In such embodiments, insertion at the block 176 will necessitate application of a force to press fit the cap sealing portion 124 into the tube first end 102 of the cylindrical tube 100. Depending on the particular implementation, such as that shown in FIG. 7, insertion may further include alignment of corresponding annular cap grooves 142 and annular tube ribs 152. With the cylinder cap 120 and/or the cylinder head 122 inserted and aligned, control may pass to a block 178 where heat may be applied to the corresponding tube end 102 and/or 104 to facilitate deformation of the cylindrical tube 100. Contemporaneously or thereafter, control may pass to a block 180 where the crimping force is applied to the tube first end 102 and/or the tube second end 104 to secure the cylinder cap 120 and/or the cylinder head 122 to the cylindrical tube 100.

The hydraulic cylinders in accordance with the present disclosure may increase the reliability of the connection of the components while reducing the time and cost of manufacturing over previously known hydraulic cylinders. Depending on the needs for serviceability for a hydraulic cylinder, one or both of the cylinder cap 120 and the cylinder head 122 may be permanently attached to the cylindrical tube via the manufacturing processes illustrated and described herein. Such connections may eliminate the need for equipment and process steps for machining cylinder threads and weld grooves into the components, welding either the cylinder cap 120 or the cylinder head 122 to the cylindrical tube 100, and applying torque to screw the cylinder cap 120 or the cylinder head 122 into the corresponding tube ends 102, 104. The need and expense for separate attachment components such as retaining rings may also be eliminated. Despite the cost and manufacturing reductions, the attachment mechanisms in accordance with the present disclosure may provide sufficient strength to reliably retain the cylinder caps 120 and cylinder heads 122 in the tube ends 102, 104 without leakage of hydraulic fluid from the hydraulic cylinder 54.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A hydraulic cylinder comprising:

a cylindrical tube having a tube inner surface, a tube outer surface, a tube first end, a tube second end opposite the tube first end, and a first fluid port proximate the tube first end;

a piston head disposed within the cylindrical tube;

a piston rod connected to the piston head and extending outward from the cylindrical tube through the tube second end;

a cylinder head having a piston rod opening receiving the piston rod and having the piston rod slidable therethrough, wherein the cylinder head is inserted into and engaged by the tube second end of the cylindrical tube to retain the cylinder head therein; and a cylinder cap having a cap sealing portion with a cylindrical shape and a cylinder attachment portion, wherein the cap sealing portion has a plurality of annular cap grooves defined in a sealing portion outer surface, wherein the cap sealing portion is inserted into the tube first end and the tube outer surface proximate the tube first end is crimped down onto the cap sealing portion so that a tube material of the cylindrical tube at the tube inner surface proximate the tube first end is disposed in the plurality of annular cap grooves to retain the cap sealing portion within the tube first end and seal the tube first end of the cylindrical tube, wherein the plurality of annular cap grooves has a rectangular cross-section.

2. The hydraulic cylinder according to claim 1, wherein a cap groove width of each of the plurality of annular cap grooves increases as the plurality of annular cap grooves extends inward from the sealing portion outer surface.

3. The hydraulic cylinder according to claim 1, wherein the cylindrical tube has a plurality of annular tube ribs extending radially inward from the tube inner surface proximate the tube first end, wherein each of the plurality of annular tube ribs is aligned with a corresponding one of the plurality of annular cap grooves when the cap sealing portion is inserted into the tube first end of the cylindrical tube and is disposed within the corresponding one of the plurality of annular cap grooves when the tube outer surface is crimped down onto the cap sealing portion.

4. The hydraulic cylinder according to claim 1, wherein the tube outer surface has a smaller tube outer diameter proximate the tube first end of the cylindrical tube.

5. The hydraulic cylinder according to claim 1, wherein the tube inner surface is tapered so that a tube inner diameter increases as the tube inner surface extends toward the tube first end, and wherein the cap sealing portion has a sealing portion outer diameter that is tapered so that the sealing portion outer diameter decreases as the cap sealing portion extends from the cylinder attachment portion.

6. The hydraulic cylinder according to claim 1, wherein the cylinder head has a plurality of annular head grooves defined in a head outer surface, wherein the cylinder head is inserted into the tube second end and the tube outer surface proximate the tube second end is crimped down onto the cylinder head so that the tube material of the cylindrical tube at the tube inner surface proximate the tube second end is disposed in the plurality of annular head grooves to retain the cylinder head within the tube second end and seal the tube second end of the cylindrical tube.

7. A method for manufacturing a hydraulic cylinder comprising:

forming a plurality of annular cap grooves in a sealing portion outer surface of a cap sealing portion of a cylinder cap, wherein forming the plurality of annular cap grooves comprises forming each of the plurality of annular cap grooves with a rectangular cross-section;

inserting the cap sealing portion into a tube first end of a cylindrical tube of the hydraulic cylinder; and crimping a tube outer surface of the cylindrical tube proximate the tube first end down onto the cap sealing portion so that a tube material of the cylindrical tube at a tube inner surface proximate the tube first end is disposed in the plurality of annular cap grooves to retain the cap sealing portion within the tube first end and seal the tube first end of the cylindrical tube.

8. The method for manufacturing a hydraulic cylinder according to claim 7, reducing a tube outer diameter of the cylindrical tube proximate the tube first end before crimping the tube outer surface.

9. The method for manufacturing a hydraulic cylinder according to claim 7, wherein forming the plurality of annular cap grooves comprises forming the plurality of annular cap grooves so that a cap groove width of each of the plurality of annular cap grooves increases as the plurality of annular cap grooves extends inward from the sealing portion outer surface.

10. The method for manufacturing a hydraulic cylinder according to claim 7, comprising:

forming a plurality of annular tube ribs extending radially inward from the tube inner surface of the cylindrical tube proximate the tube first end;

aligning each of the plurality of annular tube ribs with a corresponding one of the plurality of annular cap grooves when the cap sealing portion is inserted into the tube first end so that each of the plurality of annular tube ribs is disposed within the corresponding one of the plurality of annular cap grooves when the tube outer surface is crimped down onto the cap sealing portion.

11. The method for manufacturing a hydraulic cylinder according to claim 7, applying heat to the tube first end before crimping the tube first end of the cylindrical tube.

12. The method for manufacturing a hydraulic cylinder according to claim 7, comprising:

forming a plurality of annular head grooves in a head outer surface of a cylinder head, the cylinder head having a piston rod opening receiving a piston rod extending out of a tube second end of the cylindrical tube that is opposite the tube first end;

inserting the cylinder head into the tube second end; and crimping the tube outer surface of the cylindrical tube proximate the tube second end down onto the cylinder head so that the tube material of the cylindrical tube at the tube inner surface proximate the tube second end is disposed in the plurality of annular head grooves to retain the cylinder head within the tube second end and seal the tube second end of the cylindrical tube.

13. A hydraulic cylinder comprising:

a cylindrical tube having a tube inner surface, a tube outer surface, a tube first end, a tube second end opposite the tube first end, and a first fluid port proximate the tube first end;

a piston head disposed within the cylindrical tube;

a piston rod connected to the piston head and extending outward from the cylindrical tube through the tube second end; and a cylinder head having a piston rod opening receiving the piston rod and having the piston rod slidable therethrough, wherein the cylinder head has a plurality of annular head grooves defined in a head outer surface, wherein the cylinder head is inserted into the tube second end and the tube outer surface proximate the tube second end is crimped down onto the cylinder head so that a tube material of the cylindrical tube at the tube inner surface proximate the tube second end is disposed in the plurality of annular head grooves to retain the cylinder head within the tube second end and seal the tube second end of the cylindrical tube, wherein the plurality of annular head grooves has a rectangular cross-section.

14. The hydraulic cylinder according to claim 13, wherein a head groove width of each of the plurality of annular head grooves increases as the plurality of annular head grooves extends inward from the head outer surface.

15. The hydraulic cylinder according to claim 13, wherein the cylindrical tube has a plurality of annular tube ribs extending radially inward from the tube inner surface proximate the tube second end, wherein each of the plurality of annular tube ribs is aligned with a corresponding one of the plurality of annular head grooves when the cylinder head is inserted into the tube second end and is disposed within the corresponding one of the plurality of annular head grooves when the tube outer surface is crimped down onto the cylinder head.

16. The hydraulic cylinder according to claim 13, wherein the tube outer surface has a smaller tube outer diameter proximate the tube second end.

17. The hydraulic cylinder according to claim 13, wherein the tube inner surface is tapered so that a tube outer diameter increases as the tube outer surface extends toward the tube second end, and wherein the head outer surface has a head outer diameter that is tapered so that the head outer diameter decreases as the cylinder head extends inward into the cylindrical tube.

* * * * *